US012075926B2

(12) United States Patent
Goppion

(10) Patent No.: US 12,075,926 B2
(45) Date of Patent: Sep. 3, 2024

(54) MUSEUM SHOWCASE WITH HIDDEN ACCESS TO TECHNICAL COMPARTMENT

(71) Applicant: GOPPION S.P.A., Trezzano sul Naviglio (IT)

(72) Inventor: Alessandro Goppion, Milan (IT)

(73) Assignee: GOPPION S.P.A., Trezzano sul Naviglio (IT)

( * ) Notice: Subject to any disclaimer, the term of this patent is extended or adjusted under 35 U.S.C. 154(b) by 99 days.

(21) Appl. No.: 18/068,813

(22) Filed: Dec. 20, 2022

(65) Prior Publication Data

US 2023/0190012 A1 Jun. 22, 2023

(30) Foreign Application Priority Data

Dec. 22, 2021 (IT) ..... 102021000032291

(51) Int. Cl.
*A47F 3/00* (2006.01)

(52) U.S. Cl.
CPC ..... *A47F 3/005* (2013.01); *A47F 3/002* (2013.01)

(58) Field of Classification Search
CPC ..... A47F 3/002; A47F 3/004; A47F 3/005; A47F 3/007; A47F 3/0426; A47F 3/043; A47F 3/0434; A47F 3/125; A47F 2003/008
See application file for complete search history.

(56) References Cited

U.S. PATENT DOCUMENTS 5,069,512 A * 12/1991 Sykes ..... E06B 5/006 312/139.2
5,524,977 A 6/1996 Orawski
2014/0319979 A1* 10/2014 Goppion ..... A47F 3/005 312/138.1

(Continued)

FOREIGN PATENT DOCUMENTS

CN 106235788 A 12/2016
DE 202013102868 U1 * 10/2014 ..... A47F 3/005

(Continued)

OTHER PUBLICATIONS

Italian Search Report and Written Opinion for International Italian Application No. IT 102021000032291, filed on Dec. 22, 2021, on behalf of GOPPION S.p.A., Mailed on Jul. 12, 2022, 4 Pages.

*Primary Examiner* — Andrew Roersma
(74) *Attorney, Agent, or Firm* — Steinfl + Bruno LLP

(57) ABSTRACT

A museum showcase includes a base, with a laterally accessible technical compartment and an upper platform, and an exhibition space above the platform, delimited by vertically extended glass walls. The glass walls include at least one multi-layered special glass wall, formed of an inner glass pane and an outer glass pane. The inner glass pane extends downwards to cover the base and includes an opening at the technical compartment. The outer glass pane extends downwards only to a height such that the opening in the inner glass pane remains free. The special glass wall includes an openable door shaped and sized to form an extension of the outer glass pane downwards to cover the base. In this way, the opening of the technical compartment is accessible by opening the door, without having to open access to the exhibition space. The inner glass pane ensures that the exhibition space remains closed.

8 Claims, 5 Drawing Sheets

(56) References Cited

U.S. PATENT DOCUMENTS

| | | | | |
|---|---|---|---|---|
| 2016/0000236 | A1* | 1/2016 | Goppion | E05D 15/56 312/138.1 |
| 2016/0331153 | A1* | 11/2016 | Goppion | E05F 15/638 |
| 2017/0251834 | A1* | 9/2017 | Goppion | A47F 3/12 |
| 2020/0329887 | A1* | 10/2020 | Goppion | A47F 3/005 |

FOREIGN PATENT DOCUMENTS

| | | | | |
|---|---|---|---|---|
| DE | 202021105471 | U1 * | 10/2021 | A47F 3/00 |
| EP | 3725188 | A1 | 10/2020 | |
| FR | 2426433 | A1 | 12/1979 | |
| KR | 100616763 | B1 * | 8/2006 | A47F 11/00 |
| KR | 2020070000775 | U * | 7/2007 | A47F 3/00 |
| KR | 100807869 | B1 * | 2/2008 | E05B 65/44 |

* cited by examiner

MUSEUM SHOWCASE WITH HIDDEN ACCESS TO TECHNICAL COMPARTMENT

CROSS REFERENCE TO RELATED APPLICATIONS

The present application claims priority to Italian Patent Application No. 102021000032291 filed on Dec. 22, 2021, the contents of which are incorporated herein by reference in their entirety.

FIELD

The present disclosure concerns a museum showcase, i.e. a showcase designed and built for the conservation and display in a protected environment of cultural assets, such as works of art, historical exhibits and the like, within the context of a display environment such as a museum, an exhibition or the like. Sometimes, the term showcase alone will be used below for the sake of brevity, although it still means a museum showcase.

BACKGROUND

Protected environment means herein and below an environment in which the atmosphere can be controlled, by monitoring one or more parameters among temperature, humidity, dust content, and pollutant content, in order to maintain the envisaged preservation conditions of the displayed objects, and in which the possibility of access to unauthorised personnel is prevented, to avoid theft or damage to the displayed objects.

Showcases of this type must therefore meet various requirements, in relation to preservation and integrity of the displayed objects. In addition, these showcases must of course guarantee the best visibility for the displayed objects.

In order to improve visibility, showcase manufacturers try as far as possible to use transparent materials—typically glass—for the walls of the showcases. In addition to ensuring the best visibility of the displayed objects, the extensive use of glass is often desired by showcase designers because the transparency of the material makes it possible to give maximum prominence to the displayed objects.

Showcases were then developed with a base surmounted by a case formed by panels; in the base there is provided a technical compartment that houses the technical components necessary to ensure that the environment inside the case is protected and is therefore normally closed by non-transparent walls, which conceal all the technical components from view; conversely, the walls of the case are in whole or in part made of glass, for the aforementioned reasons.

The possibility of access to the inside of the case, for housing, removal or maintenance of the displayed objects, is normally achieved by providing that one of the side panels is an openable door.

The possibility of access to the technical components in the base must then be ensured; to this end, the technical compartment is closed by an openable door, which is accessible on one side of the base or accessible from inside the case.

To reduce the visual impact of the showcase, showcases have recently been proposed in which the glass walls extend to cover also the base, wherein the portions at the base are shielded, for example by means of opaque paints. In this way, the base is substantially invisible. The appearance of the showcase is therefore particularly neat, without any element that could visually disturb enjoying the objects displayed in the showcase.

With these glass walls extended to cover the base, however, access to the technical compartment requires the opening of the showcase. This need may be particularly undesirable, especially when the showcase houses delicate objects, which require a controlled atmosphere, and/or highly valuable objects, which one does not wish to place within reach of all the personnel responsible for maintaining the showcase and therefore authorised to access the technical compartment. In these cases, therefore, it is not possible to use showcases with glass walls that extend to cover the base.

There is therefore the problem of hiding the base of the showcase from view, while maintaining the possibility of access to the technical compartment without the opening the showcase being necessary.

SUMMARY

Therefore, the present disclosure concerns a showcase according to the features recited in the independent claim or claims; preferred characteristics are reported in the dependent claims.

More particularly, the showcase according to the present disclosure comprises:

- a base, comprising a laterally accessible technical compartment and an upper platform,
- an exhibition space above the platform of the base, delimited by vertically extended glass walls, wherein the glass walls include at least one special glass wall, with a multilayer structure formed of an inner glass pane and an outer glass pane, and is characterised in that:
- the inner glass pane of the special glass wall is extended downwards to cover the base and comprises an opening at the technical compartment;
- the outer glass pane of the special glass wall is extended downwards only to a height such that the opening in the inner glass pane remains free;
- the special glass wall comprises an openable door of such a shape and size that it forms an extension of the outer glass pane downwards to cover the base.

In this way, the opening of the technical compartment is accessible by opening the door, without thereby having to open the access to the exhibition space; the inner glass pane in fact ensures that the exhibition space remains closed. At the same time, under normal closed door conditions the base is completely hidden from view by the special glass wall.

Preferably, the openable door is made of glass, more preferably the same glass as the outer glass pane of the special glass wall. In this way, when the showcase is closed and the door is also closed, the special glass wall looks like the other glass walls.

In one embodiment, the door is removably fixed to the inner glass pane of the special glass wall by means of magnets. The access operations to the technical compartment are not hindered in the least by the open door, which can be placed anywhere near the showcase.

In another embodiment, the door is hinged to the inner glass pane or to the outer glass pane of the special glass wall. Preferably, the door is hinged at the bottom, so that during operations in the technical compartment the door can remain in the open position, without the need for retaining systems and without constituting an obstacle.

Preferably, the special glass wall is an openable door of the showcase. This allows to have both access to the exhibition space and access to the technical room on the same side of the showcase, facilitating the placement of the showcase in a modestly sized museum environment. Where there are no space problems around the showcase, the special glass wall can be any one of the glass walls, either openable or not.

Preferably, in the case where the special glass wall is an openable door, the showcase comprises opening mechanisms of the openable door, mounted between the inner glass pane and a supporting structure of the showcase. The inner glass pane of the special glass wall therefore forms the supporting part thereof. Preferably, the showcase comprises on the inner glass pane safety locking means of the openable door, to prevent access to the exhibition space by unauthorised personnel.

Preferably, the showcase comprises sealing means between the platform and the inner glass pane of the openable door, so as to seal the exhibition space.

BRIEF DESCRIPTION OF THE DRAWINGS

Further characteristics and advantages of the embodiments of the disclosure will be more evident from the following description of a preferred embodiment thereof, made with reference to the appended drawings. In such drawings.

DETAILED DESCRIPTION

Figure 1:
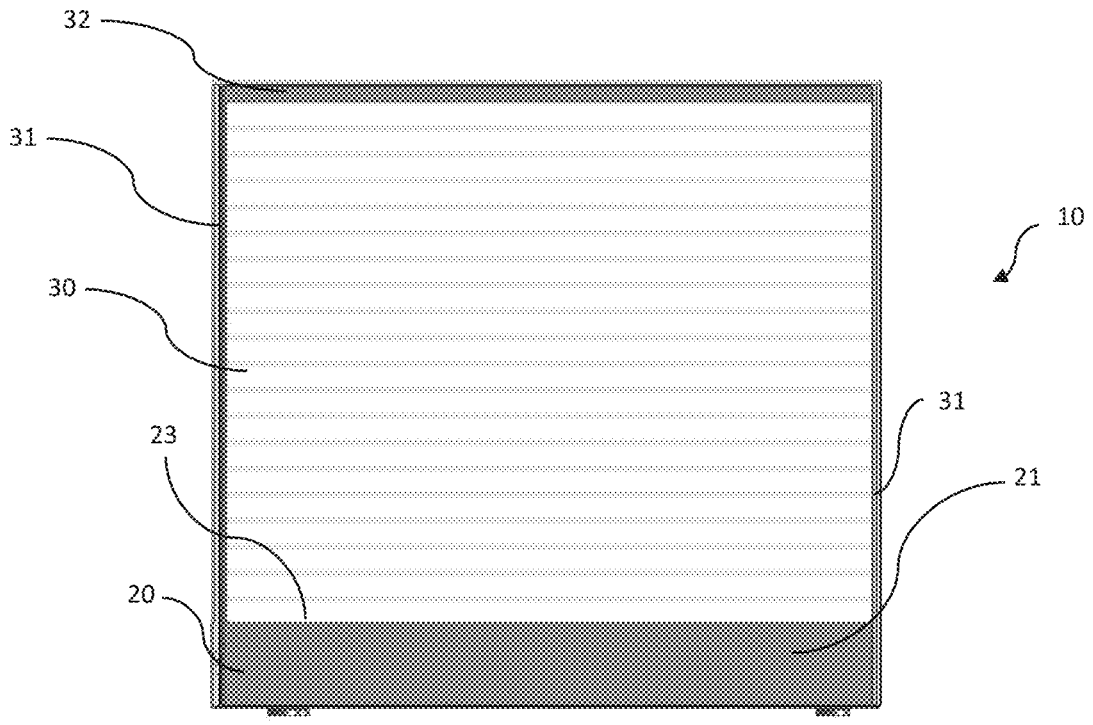
FIG. 1 is a schematic front view of a showcase according to an embodiment of the present disclosure.
Figure 2:
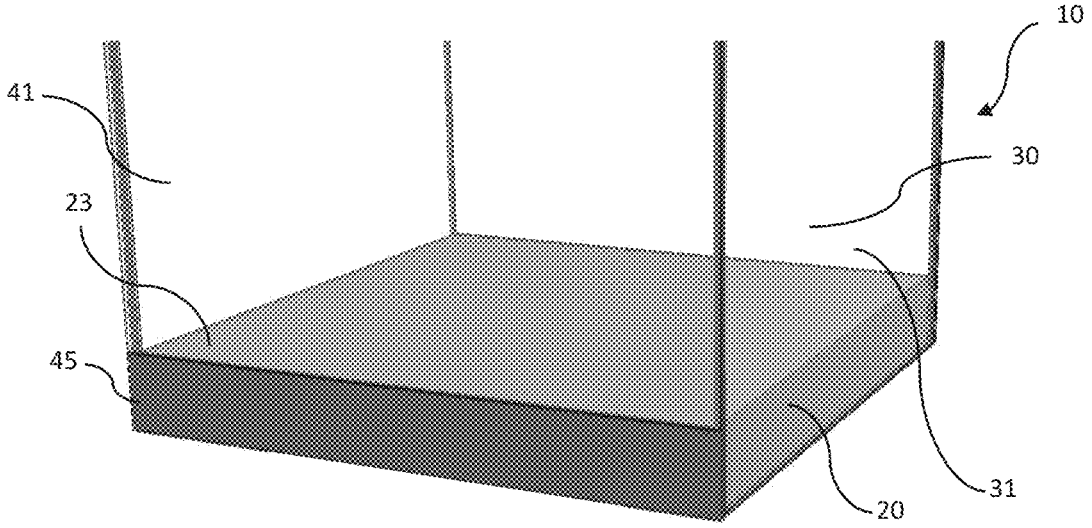
FIG. 2 is a schematic perspective view of the lower part of the showcase of FIG. 1, with the door closed.
Figure 3:
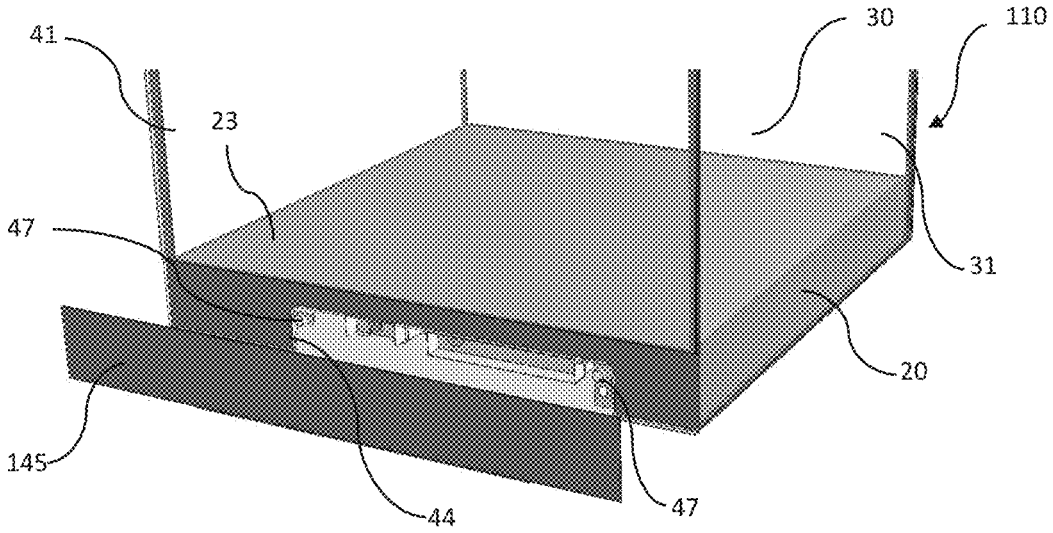
FIG. 3 is a schematic perspective view of the lower part of the showcase of FIG. 1, with the door open.
Figure 4:
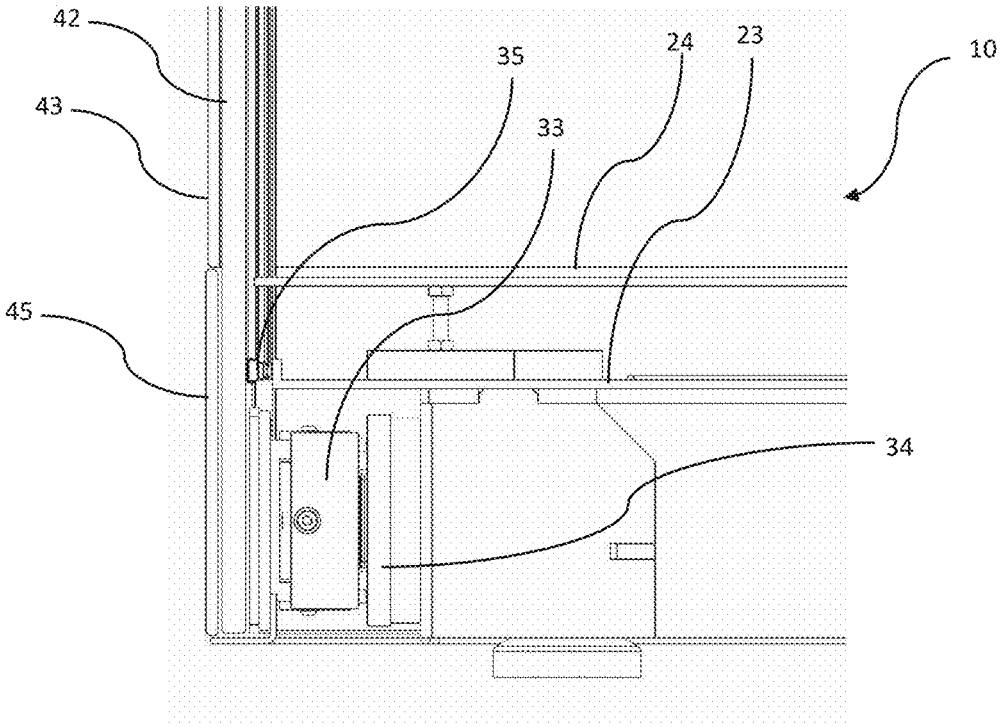
FIG. 4 is a vertical sectional view of a lower portion of the showcase of FIG. 1, with the door closed.
Figure 5:
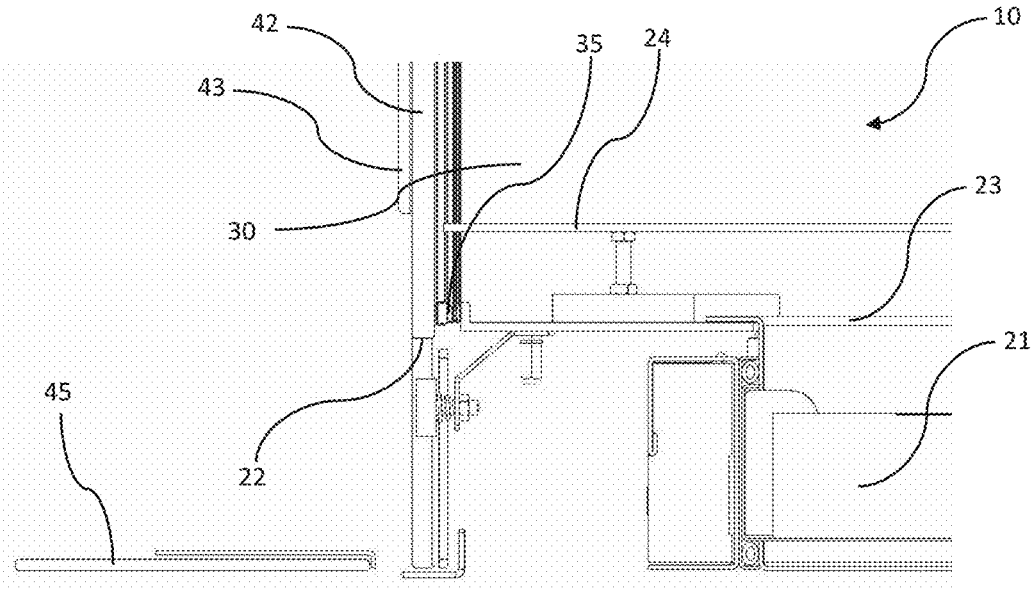
FIG. 5 is a vertical sectional view of a lower portion of the showcase of FIG. 1, with the door open.
Figure 6:
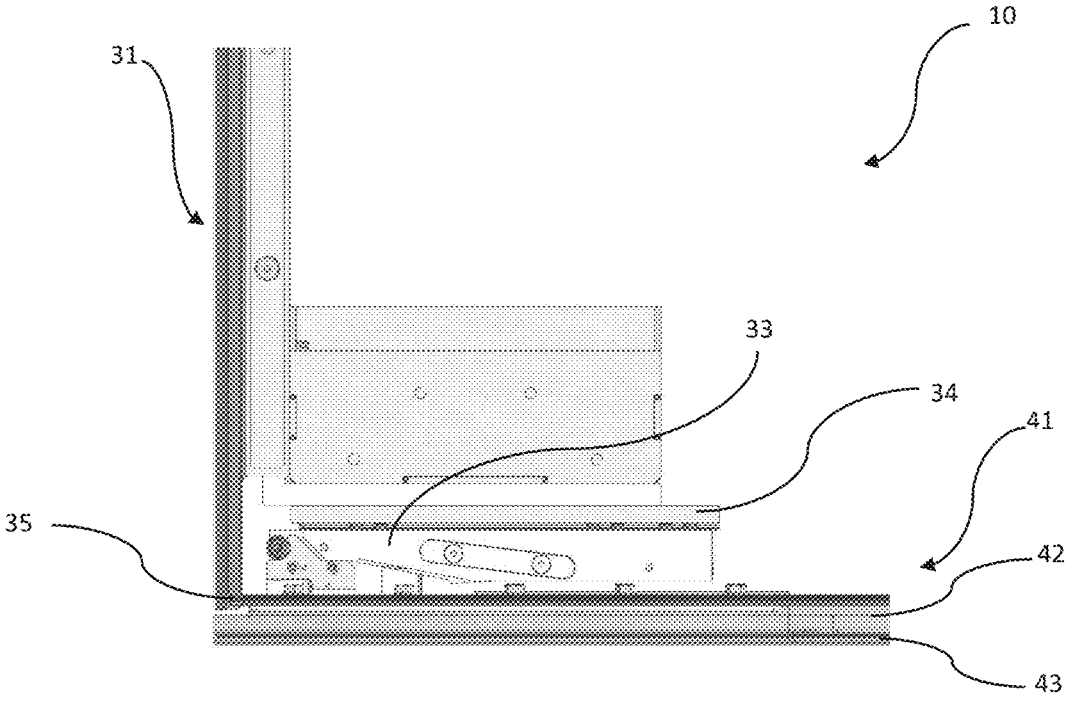
FIG. 6 is a plan sectional view of a lower portion of the showcase of FIG. 1.
Figure 7:
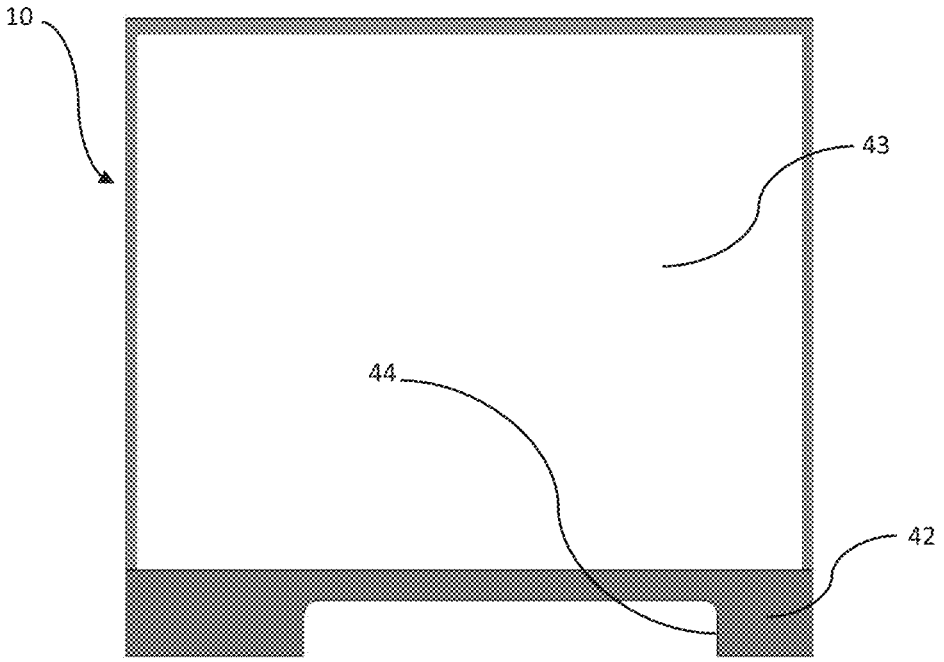
FIG. 7 is a front view of the special glass wall of the showcase of FIG. 1, without a door.
Figure 8:
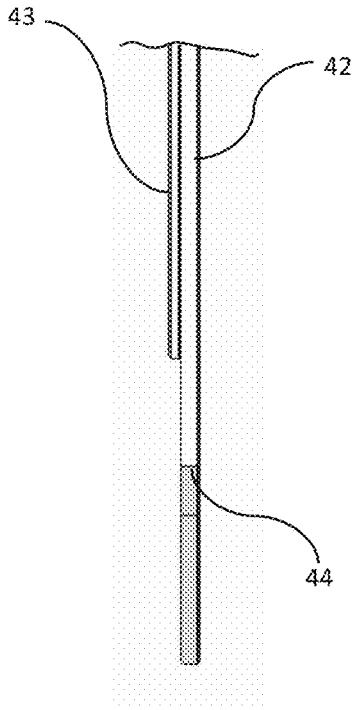
FIG. 8 is an enlarged scale side view of the lower portion of the special glass wall of FIG. 8, without a door.
Figure 9:
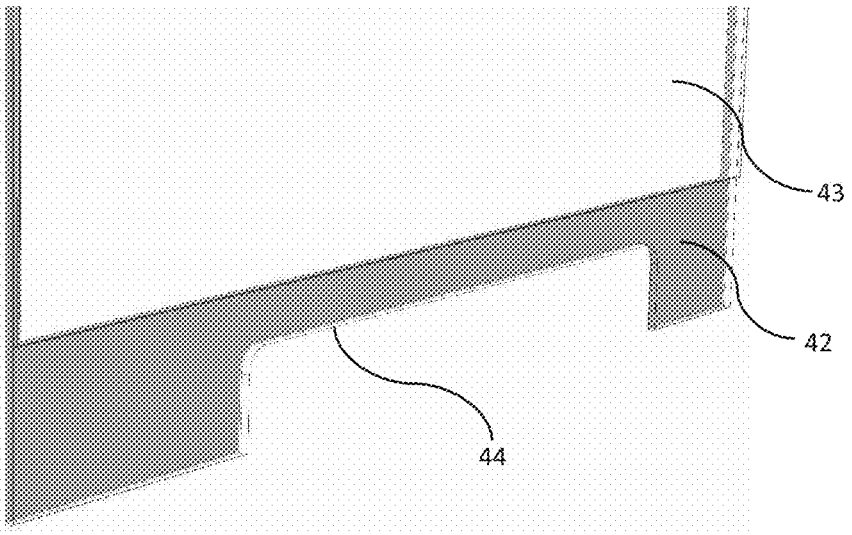
FIG. 9 is a perspective view of the lower portion of the special glass wall of FIG. 8, without a door.

In the figures, 10 indicates a museum showcase, which comprises a lower base 20 and an upper exhibition space 30.

The base 20 comprises in its inside a technical compartment 21, accessible laterally through an opening 22, and is provided at the top with a platform 23, which separates the base 20 from the exhibition space 30. In the exhibition space 30, there is provided a rest surface 24 to place the objects to be displayed in the showcase 10.

The exhibition space 30 is delimited by glass walls, in particular fixed glass walls 31 and an openable door 41, all extended vertically and surmounted by an upper ceiling 32. The showcase 10 comprises opening mechanisms of the openable door 41, for example hinges 33 mounted between the openable door 41 and a supporting structure 34 of the showcase 10. Gaskets 35 are provided between the openable door 41 and the fixed glass walls 31 and between the openable door 41 and the platform 23, so as to ensure the sealing of the exhibition space 30. The showcase 10 may also be provided with safety locking means of the openable door 41, for example one or more locks; such means are in themselves conventional and are not illustrated in the figures.

One of the glass walls, in particular the openable door 41 in the showcase 10 shown in the figures, is formed by a special or dedicated glass wall, indicated by the same reference 41 in the figures; it is also possible that the special glass wall is one of the fixed glass walls.

The glass walls 31 and 41 are made with a multilayer structure, formed by several glass panes coupled together by layers of suitable polymeric material, according to a technique known in itself in the field. In particular, the special glass wall 41 comprises an inner glass pane 42 (i.e. facing the exhibition space 30 inside the showcase 10) coupled to an outer glass pane 43, by means of a polymeric film (not highlighted in the figures). The hinges 33 are fixed to the inner glass pane 42, which therefore has a supporting function within the special glass wall 41; again the inner glass pane 42 is the one which compresses the gaskets 35. Preferably, the inner glass pane 42 has a thickness greater than the outer glass pane 43.

The inner glass pane 42 is extended downwards to cover the base 20 and in its lower area it comprises an opening 44, formed precisely at the opening 22 of the technical compartment 21. On the other hand, the outer glass pane 43 is less extended downwards, in particular only to a height such that the opening 44 formed in the inner glass pane 42 remains free. The special glass wall 41 then comprises an openable door 45, which has such a shape and size that it forms an extension downwards of the outer glass pane 43; the door 45 therefore not only closes the opening 44, but completely covers the lower portion of the inner glass pane 42 and with it the base 20.

Preferably, the door 45 is made of glass, preferably with a pane of the same glass used for the outer glass pane 43, so as to be visually identical. An opaque layer (not highlighted in the figures) can be applied to the door 45, preferably on its face facing the inner glass pane 42, to shield the base 20 from view.

The door 45, as mentioned, is openable; to this end, according to a preferred embodiment of the showcase 10 according to the present disclosure, the door 45 is completely removable from the special glass wall 41; a pair of magnets 47 mounted on the inner glass pane 42 interacts with the door 45 itself, suitably made of a suitable metal material or provided with metal plates, and thus retains the door 45 in its closed position.

In an alternative embodiment (not illustrated) the door 45 can be hinged to the inner glass pane 42 of the special glass wall 41, by means of hinges applied at the lower end thereof. In this way, the door 45 opens by tilt-and-turn and then—once opened—remains in the open position thanks simply to its weight. In another embodiment (not illustrated) the door can be hinged at the top, to the inner glass pane or to the outer glass pane; in the case of hinging at the top, the door is preferably provided with means for keeping it in an open position.

With the showcase 10, access to technical compartment 21 is possible by opening door 45, with no need to open the entire openable door 41. This allows two important advantages: firstly, the exhibition space 30 is not opened and therefore the objects displayed therein do not undergo any variation of the environmental conditions when someone accesses the technical compartment 21; secondly, the routine maintenance of the showcase, for example the control and/or the replacement of hygroscopic material present in the technical compartment 21, can also be entrusted to personnel who are not authorised to access the displayed objects, thereby alleviating the workload of the higher-level personnel.

It should also be noted that the aforementioned advantages are obtained with a showcase 10 which has an extremely neat external appearance, since the door 45 for access to the technical compartment 21 is completely camouflaged and de facto invisible, as if the special glass wall 41 were simply extended downwards to cover the base 20.

The invention claimed is:

1. A museum showcase comprising:

a base comprising a laterally accessible technical compartment and an upper platform, an exhibition space above the upper platform, delimited by vertically extended glass walls, wherein the glass walls include at least one special glass wall with a multilayer structure formed of an inner glass pane and an outer glass pane, wherein:

the inner glass pane of the special glass wall extends downwards to cover the base and comprises an opening at the technical compartment;

the outer glass pane of the special glass wall extends downwards only to a height such that the opening in the inner glass pane remains free; and the at least one special glass wall comprises an openable door shaped and sized to form an extension of the outer glass pane downwards to cover the base.

2. The museum showcase according to claim 1, wherein the openable door is made of glass.

3. The museum showcase according to claim 1, wherein the openable door is hinged to the inner glass pane or to the outer glass pane of the special glass wall.

4. The museum showcase according to claim 1, wherein the openable door is removably fixed to the inner glass pane of the special glass wall through magnets.

5. The museum showcase according to claim 1, wherein the special glass wall is an openable door of the museum showcase.

6. The museum showcase according to claim 5, further comprising opening mechanisms of the openable door, mounted between the inner glass pane and a supporting structure of the museum showcase.

7. The museum showcase according to claim 6, further comprising sealing means between the upper platform and the inner glass pane of the openable door.

8. The museum showcase according to claim 5, further comprising, on the inner glass pane, safety locking means of the openable door.

* * * * *